US010084226B2

(12) United States Patent
Mellas

(10) Patent No.: US 10,084,226 B2
(45) Date of Patent: Sep. 25, 2018

(54) SATELLITE DISH HEATER

(71) Applicant: David Mellas, Riverton, UT (US)

(72) Inventor: David Mellas, Riverton, UT (US)

( * ) Notice: Subject to any disclaimer, the term of this patent is extended or adjusted under 35 U.S.C. 154(b) by 111 days.

(21) Appl. No.: 15/010,739

(22) Filed: Jan. 29, 2016

(65) Prior Publication Data

US 2017/0222296 A1 Aug. 3, 2017

(51) Int. Cl.
*H01Q 1/02* (2006.01)
*H01Q 15/16* (2006.01)

(52) U.S. Cl.
CPC ..... *H01Q 1/02* (2013.01); *H01Q 15/16* (2013.01)

(58) Field of Classification Search
CPC ..... H01Q 15/16; H01Q 1/02; H01Q 1/50
USPC ..... 343/704
See application file for complete search history.

(56) References Cited

U.S. PATENT DOCUMENTS 5,617,107 A * 4/1997 Fleming ..... H01Q 1/02 343/704
7,508,351 B2 * 3/2009 Greenleaf ..... H01Q 1/02 343/872
7,868,845 B2 * 1/2011 Gratton ..... F16B 2/10 343/878
8,305,278 B2 * 11/2012 Corn ..... H01Q 1/02 343/704
8,421,690 B2 * 4/2013 Cummings ..... H01Q 1/02 343/704
2010/0295742 A1 * 11/2010 Corn ..... H01Q 1/02 343/704
2011/0205131 A1 * 8/2011 Jones ..... H01Q 1/02 343/704
2014/0028506 A1 * 1/2014 Wallace ..... H01O 19/12 343/704

* cited by examiner

*Primary Examiner* — Huedung Mancuso
(74) *Attorney, Agent, or Firm* — Dax D. Anderson; Kirton McConkie

(57) ABSTRACT

A heated satellite dish for reducing snow and ice accumulation on a satellite dish is disclosed. The heated satellite dish includes a heating system which may include a front pad attached to a flexible rear pad, the heating system disposed between the flexible front pad and the flexible rear pad, and a securing system comprising magnets. The satellite dish heater conforms to a rear surface of a satellite dish and the magnets selectively and detachably secure the satellite dish heater against the rear surface of the satellite dish. The heating system transfers heat to the rear surface of the satellite dish to reduce snow and ice accumulation.

12 Claims, 5 Drawing Sheets

SATELLITE DISH HEATER

BACKGROUND

This disclosure pertains to a heated satellite dish. More particularly, some implementations of the present disclosure relate to systems and methods for heating a satellite configured to prevent snow and/or ice buildup on a satellite antenna.

Conventional satellite dish antennas are configured to receive signals from satellites such as satellite television broadcasts. Conventional satellite dish antennas normally comprise a parabolic-shaped dish that reflects the satellite signal to a focal point. A receiver such as a feedhorn is placed at the focal point to gather the satellite signal and to pass it on to a processor such as a set-top box that converts the signal for viewing. To effectively receive the satellite signal, the parabolic-shaped dish must have a direct line-of-sight view with the satellite that is transmitting the satellite signal. To achieve a clear line-of-sight view with the satellite, satellite dishes are often mounted on a roof of a house or other similar structure so that the line-of-sight is unobstructed. Because of these types of rooftop mountings, access to mounted satellite dishes can be limited and/or difficult.

Conventional satellite dishes can suffer from loss of reception when snow and/or ice accumulate on the parabolic-shaped dish. Accumulation of snow and/or ice on the parabolic-shaped dish can prevent the satellite signal from being effectively reflected from a front surface of the parabolic-shaped dish to the receiver. Often, snow and/or ice accumulation must either be allowed to melt or must be removed manually. Removing snow and/or ice accumulation manually from the satellite dish can be difficult because of limited access to roof-mounted dishes. It can be difficult and/or dangerous for a person to gain access to these roof-mounted satellite dishes (e.g. by climbing a ladder onto the roof) and the roof can be snowy and/or icy and add to the risk of injury and/or death (e.g. from slipping and/or falling from the roof).

Additionally, manual clearing of accumulation of snow and/or ice on the parabolic-shaped dish can lead to misalignment and/or damage of the dish. Cleaning snow and/or ice from the dish by using hands can lead to this misalignment and/or damage. Also, tools such as broomsticks or similar items are often used to manually clear snow and ice accumulation and can lead to similar damage and/or misalignment.

Although accumulation of snow and/or ice from the parabolic-shaped dish can be removed manually, manually removing snow and/or ice accumulation is not without its shortcomings. For example, manually removing accumulation can be dangerous and can lead to injury and/or death. Another shortcoming is that manually removal of accumulation can lead to misalignment and/or damage of the satellite dish. Furthermore, it is often necessary to manually remove snow and/or ice several times during a lengthy winter storm or during and/or after multiple winter storms.

Thus, while snow and/or ice can be manually removed from a satellite dish, challenges still exist, including those listed above. Accordingly, it would be an improvement in the art to augment or even replace current techniques with other techniques.

BRIEF SUMMARY

Described herein are some embodiments of a heated satellite dish. In some embodiments, the heated satellite dish comprises a dish wherein a heating system is integrated into the dish to heat the surface the satellite dish. In some embodiments comprise a retrofit satellite dish heater comprising a rear pad configured to conform to a rear surface of a satellite dish, a heating system configured to transfer heat to the satellite dish, and a securing system configured to selectively and detachably secure the satellite dish heater to the rear surface of the satellite dish. In other embodiments, the rear pad comprises a cut-out portion configured to accommodate a mounting bracket. In yet other embodiments, the rear pad also comprises a flap configured to contact the rear surface of the satellite dish within the cut-out portion. In some embodiments, the rear pad comprises a synthetic rubber. In other embodiments, the rear pad is configured to be flexible to conform to a rear surface of the satellite dish. In yet other embodiments, the heating system comprises heating wire. In yet other embodiments, the heating wire is configured to be self-regulating to provide a constant power output. In some embodiments, the self-regulating heating wire is configured to provide a constant power output of about 3 to about 20 watts per foot at 50° F. In other embodiments, the securing system comprises one or more magnets configured selectively and detachably secure the satellite dish heater to the rear surface of the satellite dish. In yet other embodiments, the magnets comprise neodymium magnets.

In some embodiments, the system for reducing snow and ice accumulation on a satellite dish comprises a heating system and a securing system with the securing system configured to secure the heating system against the rear surface of the satellite dish, and with the heating system transferring heat to the satellite dish to reduce snow and ice accumulation. In other embodiments, the heating system comprises a self-regulating heating wire configured to provide a constant power output. In yet other embodiments, the securing system comprises one or more magnets. In some embodiments, the system is configured to selectively and detachably secure the system to the rear surface of the satellite dish.

In some embodiments, the system for reducing snow and ice accumulation on a satellite dish comprises a flexible rear pad configured to conform to a rear surface of a satellite dish, a heating wire attached to the flexible rear pad, a magnet attached to the flexible rear pad, with the magnet configured to selectively and detachably secure the satellite dish heater against the rear surface of the satellite dish, and with the heating wire configured to transfer heat to the rear surface of the satellite dish to reduce snow and ice accumulation. In other embodiments, the system further comprises a flexible front pad attached to one or more of the flexible rear pad, the heating wire, and the magnet. In yet other embodiments, the system further comprises a pad border configured to attach the front and rear pads. In some embodiments, the system is configured to conform to at least 80% of the rear surface of the satellite dish. In other embodiments, the flexible front and rear pads further comprise a cut-out portion configured to allow the front and rear pads to fit around a mounting bracket. In yet other embodiments, the flexible front and rear pads comprise a flap configured to contact the rear surface of the satellite dish within the cut-out portion. In some embodiments, the magnet is disposed between the flexible front pad and the flexible rear pad.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

The present disclosure relates to satellite dish heaters. More particularly, some embodiments of the present disclosure relate to systems and methods for providing a satellite dish heater configured to reduce, remove, and/or prevent snow and/or ice accumulation on a parabolic-shaped of a satellite dish. While the satellite dish heater can have any suitable component, in some cases, it includes one or more of a rear pad configured to be selectively and detachably installed against a rear surface of the parabolic dish, a heating system configured to generate heat, a securing system configured to selectively and detachably secure the satellite dish heater to the satellite dish, and a front pad attached to the rear pad.

In the disclosure and in the claims, the term satellite dish (and variations thereof) may be used to refer to any antenna configured to receive electromagnetic signals (including satellite signals) and comprising a dish component (including a parabolic dish). The term satellite dish can include a motor driven dish, a multi-satellite dish, a very small aperture terminal (VSAT) dish, a direct to home (DTH) dish, a collective dish, a satellite master antenna television (SMATV) dish, a communal antenna broadcast distribution (CABD) dish, an automatic tracking satellite dish, a vehicle mounted satellite dish, a mini-dish, a C-band satellite dish, a residential satellite TV receiver dish, and any other similar satellite dishes.

A heated satellite dish is disclosed. The dish comprises a dish 60. A heating system is placed on the satellite dish so as to allow the heating system to raise the temperature of the dish either through direct contact, or conduction. In some embodiments the heating system is applied to the concave surface of the dish. The heating system may be placed on any surface of the dish and arranged to allow at least a portion of the dish 60 to increase in temperature. The heating system's placement may be arranged so as to minimize or eliminate the system's signal interference. In some embodiments the heating system may be placed on the dish's 60 periphery. In some embodiments the heating system may be placed on the dish's center. In some embodiments the heating system may be placed between the dish's periphery and the dish's center. In some embodiments the heating system is placed inside a cavity in the satellite dish, such as inside the supporting pole 64 which supporting the satellite dish wherein the heated supporting pole heats the dish 60 through conduction. In some embodiments the heating system may be placed directly on the back of the dish 60. In some embodiments the heating system may be placed on the dish and covered by materials such as metal, or some other protective material. In some embodiments the heating system is integrated into a cavity behind the back surface of the dish 60.

Figure 1:
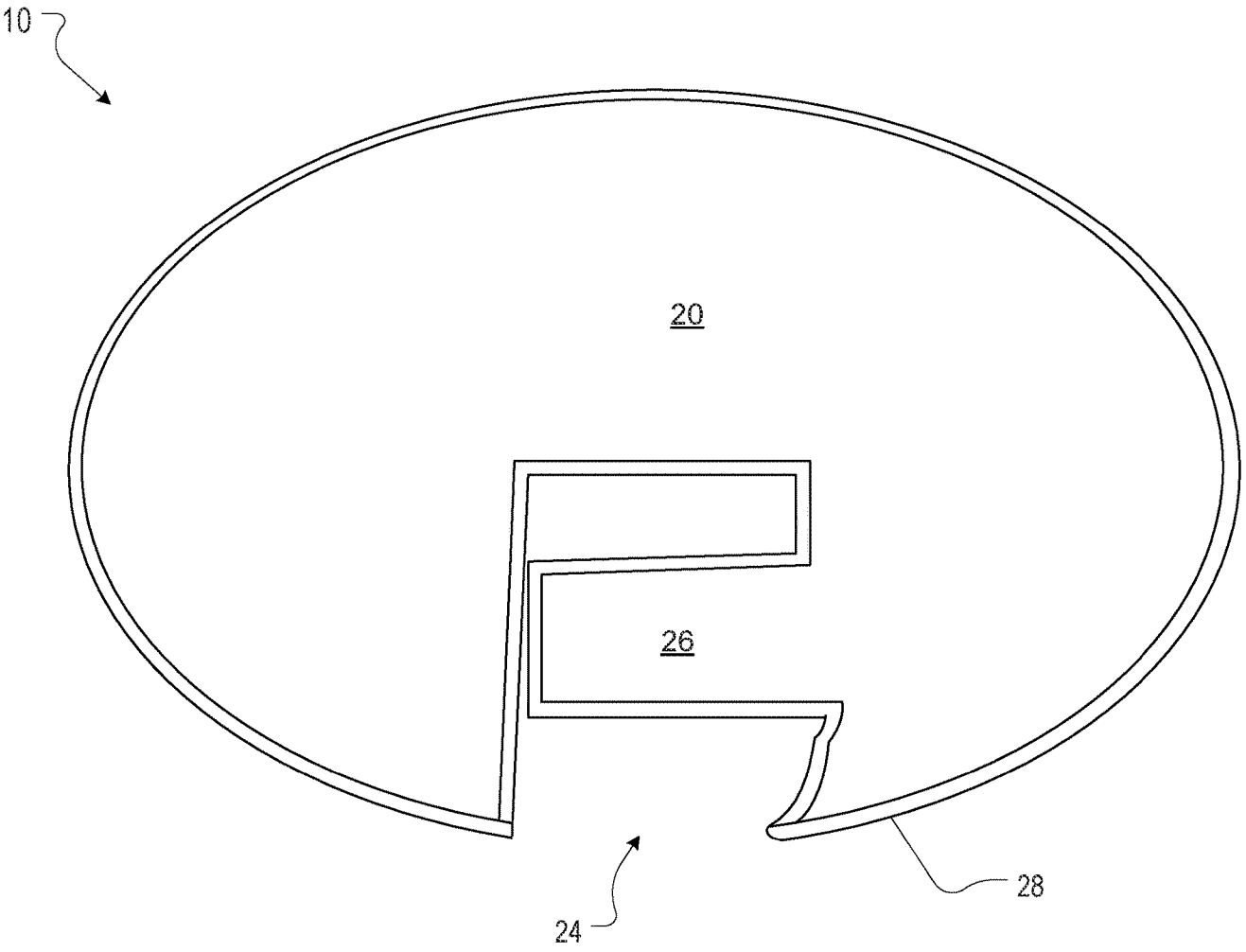
FIG. 1 illustrates a front view of embodiments of a satellite dish heater.

In general (and as mentioned above), some embodiments of the described systems and methods relate to a satellite dish heater having a rear pad configured to be installed against a rear surface of the parabolic dish. While the described satellite dish heater can comprise any suitable component or characteristic, FIG. 1 shows that at least in some embodiments, the satellite dish heater 10 comprises a rear pad 20. Additionally, FIG. 1 shows that, at least in some embodiments, the rear pad 20 further comprises a cut-out portion 24 configured to accommodate any satellite dish components attached to the rear surface of the satellite dish. For example, the cut out portion 24 can be configured to accommodate a mounting bracket or similar support structure. The rear pad 20 can also comprise additional cut-out portions to accommodate other support components, electrical connections, motors, power supplies, electronics, and any other similar satellite dish components. In some instances, the rear pad 20 can further comprise a rear flap 26. The rear flap 26 can be configured to contact the rear surface of the parabolic dish over an area within the cut-out portion 24. For example, the rear flap 26 can be configured to contact the rear surface of the parabolic dish between mounting points of a mounting bracket. The rear pad 20 can also comprise a pad border 28. In some embodiments, the pad border 28 comprises a border portion of the rear pad 20. In other embodiments, the pad border 28 comprises a separate portion of material.

With respect to the rear pad 20, the rear pad 20 can be configured in any shape suitable for selective and detachable installation against a rear surface of the parabolic dish. In some embodiments, the rear pad 20 comprises a round shape configured to conform to the shape of the rear surface of the parabolic dish. Nevertheless, FIGS. 1-5 show that, in some embodiments, the rear pad 20 comprises an oval shape configured to conform to a shape of the rear surface of the parabolic dish. In some embodiments, the rear pad is configured to conform to at least 80% of the rear surface of the parabolic dish. In other embodiments, the rear pad is configured to conform to between about 10% and about 90% of the rear surface of the parabolic dish. In yet other embodiments, the rear pad is configured to conform to at least about 10%, about 20%, about 30%, about 40%, about 50%, about 60%, about 70%, about 80%, about 90%, or about 95% of the rear surface of the parabolic dish. Additionally, the rear pad 20 can be configured as one or more of a sheet, a membrane, a planar surface, a layer, a film, or any other similar shape.

With regards to the rear pad 20, the rear pad 20 can comprise any material or blend of materials suitable for the satellite dish heater 10 to function as intended. Indeed, in some embodiments, the rear pad 20 comprises a sheet of material such as synthetic rubber. In other embodiments, the rear pad 20 comprises one or more sheets and/or layers of rubber and/or synthetic rubber (e.g., polyacrylate rubber, ethylene-acrylate rubber, polyester urethane, bromo isobutylene isoprene, polybutadiene, chloro isobutylene isoprene, polychloroprene, chlorosulphonated polyethylene, epichlorohydrin, ethylene propylene, ethylene propylene diene monomer, polyether urethane, perfluorocarbon rubber, fluoronated hydrocarbon, fluoro silicone, fluorocarbon rubber, hydrogenated nitrile butadiene, polyisoprene, isobutylene isoprene butyl, acrylonitrile butadiene, polyurethane, styrene butadiene, styrene ethylene butylene styrene copolymer, polysiloxane, vinyl methyl silicone, acrylonitrile butadiene carboxy monomer, styrene butadiene carboxy monomer, thermoplastic polyether-ester, styrene butadiene block copolymer, styrene butadiene carboxy block copolymer, and/or any other suitable synthetic rubber). In yet other embodiments, the rear pad 20 comprises one or more sheets of plastic (e.g., ABS plastic, nylon, elastomer, engineered plastic, and/or any other suitable plastic) and/or polymers (e.g., polyethylene, polycarbonate, polyvinylchloride, and/or any other suitable polymers). In some embodiments, the rear pad 20 comprises one or more sheets of rubberized fabric and/or plasticized fabric that includes one or more of the rubbers, synthetic rubbers, and/or plastics described above.

In some embodiments, the rear pad 20 comprises one or more sheets of the synthetic rubber fabric sold under the tradename HYPALON®. For example, the rear pad 20 can comprise one or more sheets of HYPALON® 20, HYPALON® 30, HYPALON® 40S, HYPALON® 40, HYPALON® 4085, HYPALON® 6525, HYPALON® 45, and/or HYPALON® 48. The rear pad 20 can include any suitable reinforcing material such as metal wire, metal mesh, fiberglass, polymer wire, polymer mesh, and/or thread. The rear pad 20 can include any material that is configured to conform to the satellite dish. In other embodiments, the rear pad 20 is configured to be one or more of temperature resistant (e.g., resistant to high and/or low temperatures and resistant to large temperature ranges and/or fluctuations), moisture resistant, resistant to sunlight (e.g., resistant to UV radiation damage), resistant to chemicals, resistant to abrasions and/or puncture, resistant to ozone, self-extinguishing when exposed to flame, and resistant to fire damage.

While the rear pad 20 can be configured in any suitable manner that allows it to function as intended, in some embodiments, the rear pad is configured to comprise a shape that allows it to conform to the rear surface of the satellite dish. For example, the rear pad 20 can comprise a curved, rounded and/or parabolic shape configured to conform to the rear surface of the satellite dish. The rear pad 20 can be configured as a rigid or semi-rigid structure that conforms to the rear surface of the satellite dish. In other embodiments, the rear pad 20 can be configured to be flexible and/or semi-flexible to conform to the rear surface of the satellite dish. For example, the rear pad 20 can comprise a flexible material such as a synthetic rubber fabric that allows the rear pad 20 to conform to the rear surface of the satellite dish. In yet other embodiments, the rear pad 20 comprises a combination of one or more rigid, semi-rigid, flexible, and semi-flexible components that allows the rear pad 20 to conform to the rear surface of the satellite dish.

Figure 2:
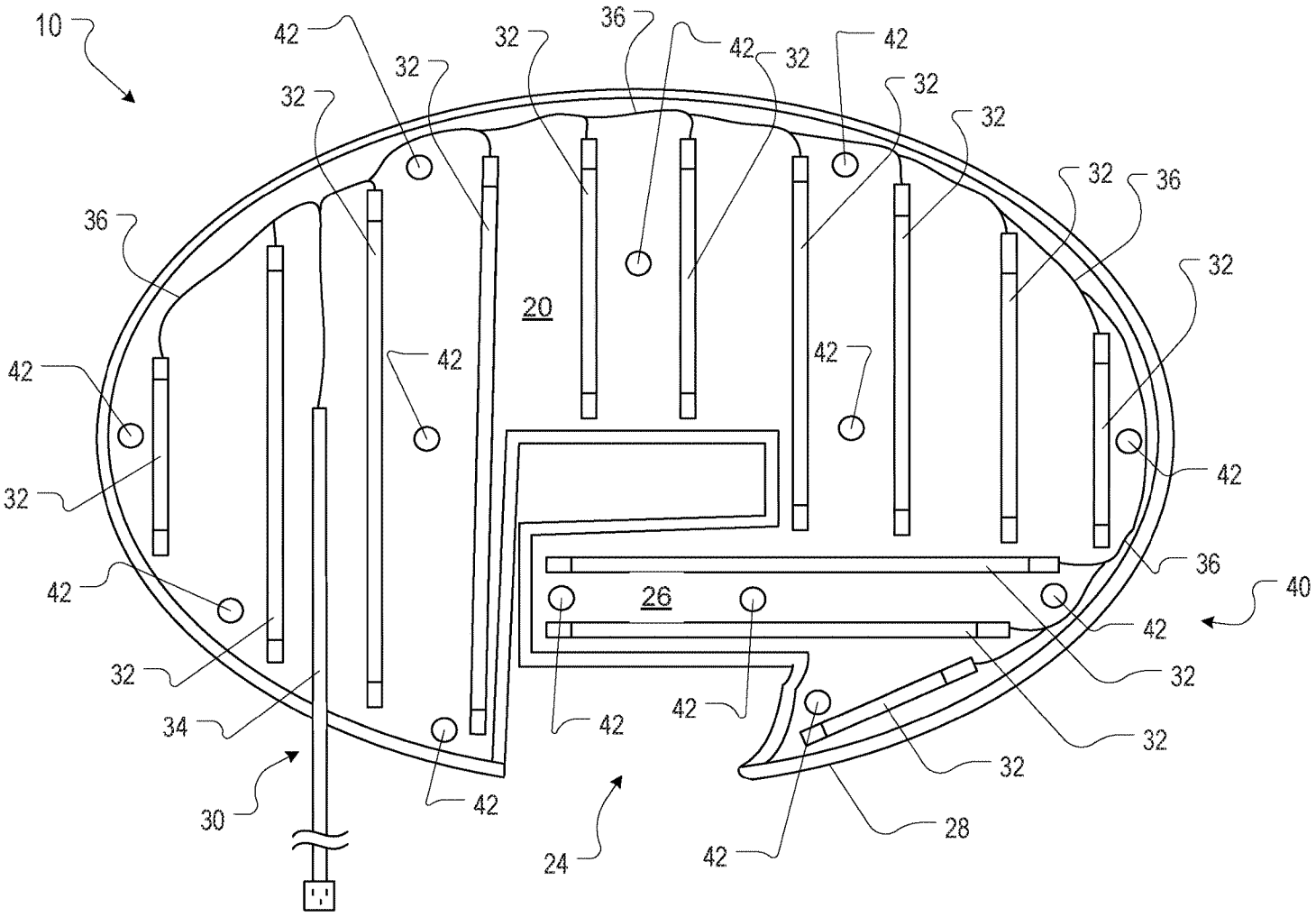
FIG. 2 illustrates a cutaway view of embodiments of a satellite dish heater.

Referring now to FIG. 2, a cutaway view of some embodiments of the satellite dish heater 10 is illustrated. FIG. 2 shows that at least in some embodiments, the satellite dish heater 10 comprises a heating system 30 configured to generate heat. While the heating system 30 can comprise any suitable component or characteristic to generate heat, at least in some embodiments, the heating system 30 comprises heating cables 32. The heating system 30 can also comprise a power supply line 34 configured to electrically connect the heating system 30 to a power supply. The heating system 30 can also comprise electrical connections 36 configured to electrically connect the power supply line 34 to the heating cables 32. The power supply line 34 can be configured to connect the heating system 30 to any suitable power supply. For example, the power supply line can connect the heating system 30 to commercial utility power. In some embodiments, the satellite dish heater comprises a suitable power supply that power supply line 34 connects to the heating system 30. For example the power supply can comprise any suitable battery such as a lead acid battery, a spiral core lead acid battery, a deep cycle marine battery, a nickel-cadmium battery, a rechargeable battery, a lithium ion battery, a primary battery, a secondary battery, a zinc-carbon battery, and or an alkaline battery. In some instances the power supply can comprise a power generator such as a solar panel (or photovoltaic module) or a portable electric generator.

In some embodiments, the heating cables 32 are affixed or otherwise secured to the rear pad 20. In other embodiments, the heating cables 32 are affixed or otherwise secured to the rear pad 20 with an adhesive such as a room temperature vulcanization (RTV) silicone sealant. In yet other embodiments, the heating cables 32 are affixed or otherwise secured to the rear pad 20 with fasteners, snaps, loops, pockets, ties, or in any other suitable manner. The heating cables 32 can be arranged in any suitable manner along the rear pad 20. For example, the heating cables 32 can be spaced substantially evenly apart along the rear pad 20 to allow for heat generated to be evenly distributed along the rear pad 20. In some cases, the heating cables 32 can be arranged vertically along the rear pad 20. In other cases, the heating cables 32 can be arranged horizontally along the rear pad 20. In yet other cases, the heating cables 32 can be arranged one or more of vertically, horizontally, and diagonally along the rear pad 20. In some instances, the heating cables 32 can also be arranged along the rear flap 26 to provide heat to this portion of the satellite dish heater 10.

With regard to the heating cables 32, the heating cables 32 can comprise any suitable component for generating heat. In some embodiments, the heating cables 32 comprise components configured to generate heat from electrical current. In other embodiments, the heating cables 32 comprise heating cable or heat trace cable that is configured to generate heat from electrical current while being one or more of self-regulating, self-limiting, and/or constant-wattage. In yet other embodiments, the heating cables 32 comprise one or more heating cables sold under the tradename HTSX™ self-regulating heating cable. For example, the heating cables 32 can comprise self-regulating heating cable configured to generate between about 3 to about 20 watts per foot at 50° F. In some cases, the heating cables 32 can comprise self-regulating heating cable configured to generate 3, 6, 9, 12, 15, or 20 watts per foot at 50° F. In other cases, the heating cables 32 can comprise one or more of HTSX™ 3-1 heating cable, HTSX™ 6-1 heating cable, HTSX™ 9-1 heating cable, HTSX™ 12-1 heating cable, HTSX™ 15-1 heating cable, HTSX™ 20-1 heating cable, HTSX™ 3-2 heating cable, HTSX™ 6-2 heating cable, HTSX™ 9-2 heating cable, HTSX™ 12-2 heating cable, HTSX™ 15-2 heating cable, and HTSX™ 20-2 heating cable. In yet other cases, the heating cables 32 can be configured to activate themselves when needed (such as when there is snow and/or ice buildup) and to deactivate themselves when not needed (such as when there is no snow and/or ice buildup). In some instances, the heating cables 32 can be configured to activate themselves when needed (such as when there is snow and/or ice buildup) and to deactivate themselves when not needed (such as when there is no snow and/or ice buildup) to reduce overheating and energy consumption. In other instances, the heating cables 32 can be configured to be self-regulating to maintain generated heat within any suitable temperature range.

In some embodiments, power supply line 34 comprises a ground line configured to electrically ground the satellite dish heater 10. In other embodiments, the electrical connections 36 are also configured to provide an electrical ground connection between the heating cables 32 and the power supply line 34. In yet other embodiments, the satellite dish heater 10 is configured to be electrically grounded to prevent injury or death to a user that is installing or using the satellite dish heater 10.

With continued reference to FIG. 2, at least in some embodiments, the satellite dish heater 10 comprises a securing system 40 configured to selectively and detachably secure the satellite dish heater 10 to the rear surface of a satellite dish. The securing system 40 can comprise any suitable component or characteristic to allow the satellite dish heater 10 to be selectively and detachably secured to the rear surface of a satellite dish. For example the securing system 40 can comprise one or more fasteners, snaps, hooks, brackets, clips, buttons, clasps, hook and loop fasteners (e.g., VELCRO™ hook and loop fasteners) and any other similar component(s). In some embodiments, the securing system 40 comprises one or more magnets 42. The magnets 42 can be configured to selectively and detachable secure the satellite dish heater 10 to a ferrous-based metal rear surface of a satellite dish. The magnets 42 can be configured to selectively and detachably secure the satellite dish heater 10 to the ferrous-based metal rear surface of a satellite dish without marring the rear surface of the satellite dish. The magnets 42 can be configured to selectively and detachably secure the satellite dish heater 10 to the ferrous-based metal rear surface of a satellite dish without the need to make holes in the satellite dish to accommodate fasteners. The magnets 42 can be configured to selectively and detachable secure the satellite dish heater 10 to a ferrous-based metal rear surface of a satellite dish to allow for rapid and easy installation by the user.

In some embodiments, the magnets 42 are affixed or otherwise secured to the rear pad 20. In other embodiments, the magnets 42 are affixed or otherwise secured to the rear pad 20 with an adhesive such as a cyanoacrylate. In yet other embodiments, the magnets 42 are affixed or otherwise secured to the rear pad 20 with fasteners, snaps, loops, pockets, ties, or in any other suitable manner. The magnets 42 can be arranged in any suitable manner along the rear pad 20. For example, the heating cables 32 can be arranged one or more of vertically, horizontally, and diagonally along the rear pad 20.

In some embodiments, the magnets 42 comprise one or more permanent magnets. In other embodiments, the magnets 42 comprise strong, permanent magnets comprising transition metals, alloys of rare earth elements and/or lanthanide elements. The magnets can include neodymium magnets and samarium-cobalt magnets. The magnets can include magnets comprising $Nd_2Fe_{14}B$, $Nd_2Fe_{14}B$, $SmCo_5$, and/or $Sm(Co,Fe,Cu,Zr)_7$. In yet other embodiments, the magnets can comprise ferrous magnets or alnico magnets. In some embodiments, the magnets can comprise ferrous based magnets, alnico based magnets and rare earth magnets. In other embodiments, the magnets can comprise electromagnets. In yet other embodiments, the magnets can comprise electromagnets comprising a ferromagnetic core. In some embodiments, the magnets 42 comprise neodymium magnets (e.g., neodymium iron boron magnets, NdFeB magnets, NIB magnets, or Neo magnets).

Figure 3:
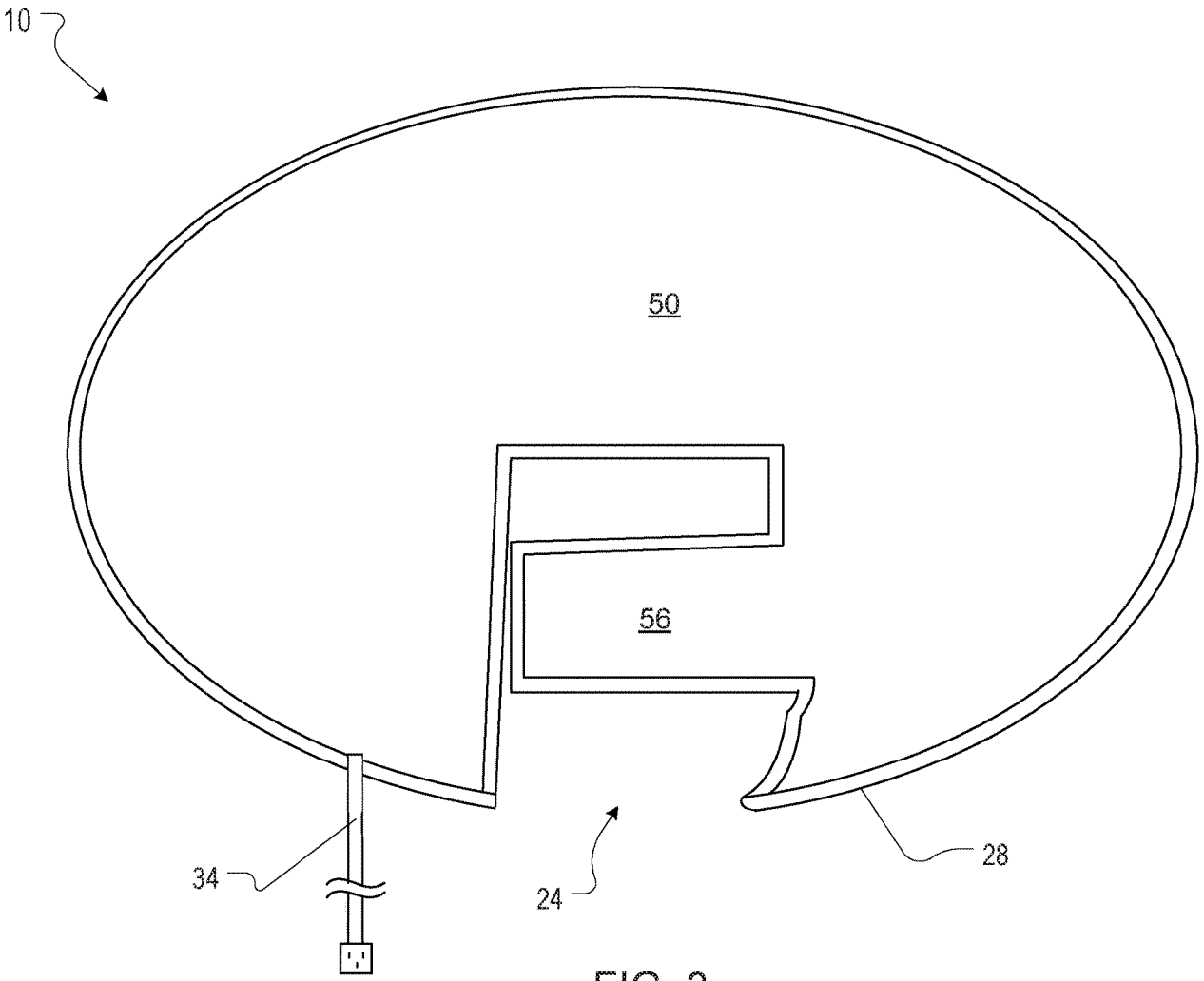
FIG. 3 illustrates a front view of embodiments of a satellite dish heater.

Referring now to FIG. 3, a front view of some embodiments of the satellite dish heater 10 is illustrated. FIG. 3 shows that at least in some embodiments, the satellite dish heater 10 comprises a front pad 50. The front pad 50 can be configured to cover the rear pad 20 and one or more of the heating system 30 and the securing system 40. As described above, and similar to the rear pad 20, the front pad 50 can be configured in any suitable shape. In some embodiments, the front pad 50 is shaped to cover the rear pad 20 and to cover the heating system 30 and the securing system 40. The front pad 50 can also comprise a front flap 56 configured to cover the rear flap 26. The front pad 50 can be configured with one or more of a rigid configuration, a semi-rigid configuration, a flexible configuration and a semi-flexible configuration configured to conform to a shape of the satellite dish.

In some embodiments, the front pad 50 can be configured to be attached to the rear pad 20 by a perimeter of the front pad 50 to a perimeter of the rear pad 20. The front pad 50 can also be configured to be attached to the pad border 28. The front pad 50 can also be configured to be attached to one or more of the heating system 30 and the securing system 40. The front pad 50 can be attached to the rear pad 20 in any suitable manner including by bonding with adhesive, by bonding with sealant, by heat welding, by crimping, by riveting, by sewing, by using fasteners, and/or by any other suitable manner. In some embodiments, the front pad 50 is attached to the rear pad 20 with an RTV sealant. In other embodiments, the front pad 50 is attached to the rear pad 20 with a cyanoacrylate adhesive. In yet other embodiments, the front pad 50 is attached to the rear pad 20 with one or more of a watertight seal and an airtight seal.

While the front pad 50 can comprise any material or blend of materials suitable for the satellite dish heater to function as intended, in some embodiments, the front pad 50 comprises a sheet of synthetic rubber and/or any of the other materials described above for the rear pad. In other embodiments, the front pad 50 comprises one or more sheets and/or layers of materials as described above for the rear pad 20. In yet other embodiments, the front pad 50 comprises one or more of a rigid material, a semi-rigid material, a flexible material and a semi-flexible material configured to conform to a shape of the satellite dish.

The satellite dish heater 10 can include any suitable component configured to allow it to effectively reduce snow and ice accumulation. For example the satellite dish heater 10 can comprise a microprocessor configured to control the heating system 30. In some instances the microprocessor controls one or more of activating the heating system, deactivating the heating system, the amount of power supplied to the heating system, the length of time that the heating system is activated, and cycling of the heating system between powered on and powered off conditions. The microprocessor can be configured to control any other suitable processes related to reducing snow and ice accumulation. The satellite dish heater 10 can also include any other suitable component to control the heating system 30 including, but not limited to, switches, electrical couplings, fuses, electrical breakers, indicator lights, timers, and other similar electrical components.

The described satellite dish heater can also be made in any suitable manner. In this regard, some non-limiting examples of methods for making the described satellite dish heater include, one or more techniques comprising extruding, stamping, casting, machining, cutting, etching, additive manufacturing, bending, folding, drilling, welding, melting, shaping, molding, connecting various pieces with one or more fasteners (e.g., adhesives, mechanical fasteners, frictional fasteners, pins, rivets, hinges, crimps, clips, brads, screws, nails, pegs, springs, etc.), melting pieces together, EDM cutting, machining, finishing, grinding, buffing, polishing, coating, tumbling, anodizing, and/or any other suitable method that allows the described satellite dish heater to be formed and to perform its intended functions.

Figure 4:
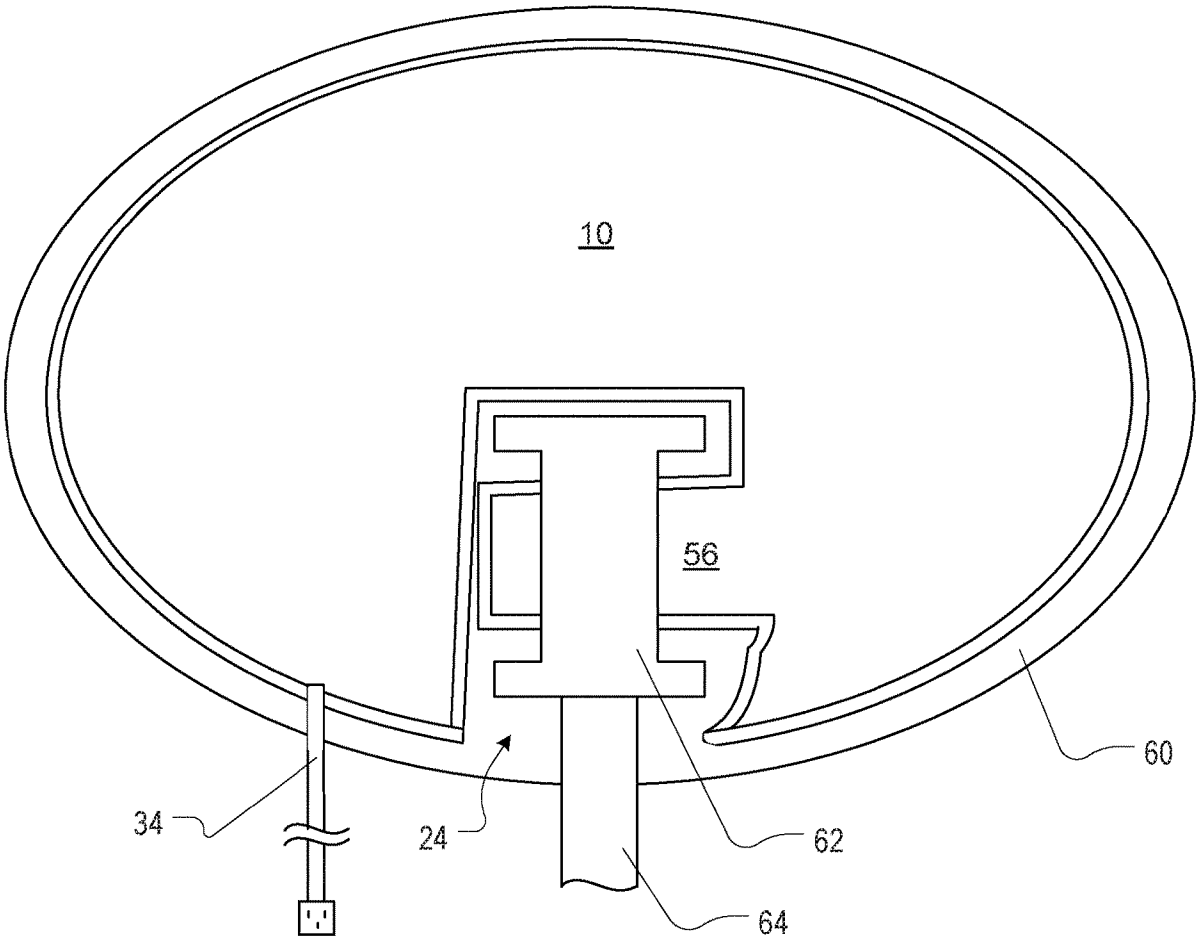
FIG. 4 illustrates a front view of embodiments of a satellite dish heater secured to a rear portion of a satellite dish.
Figure 5:
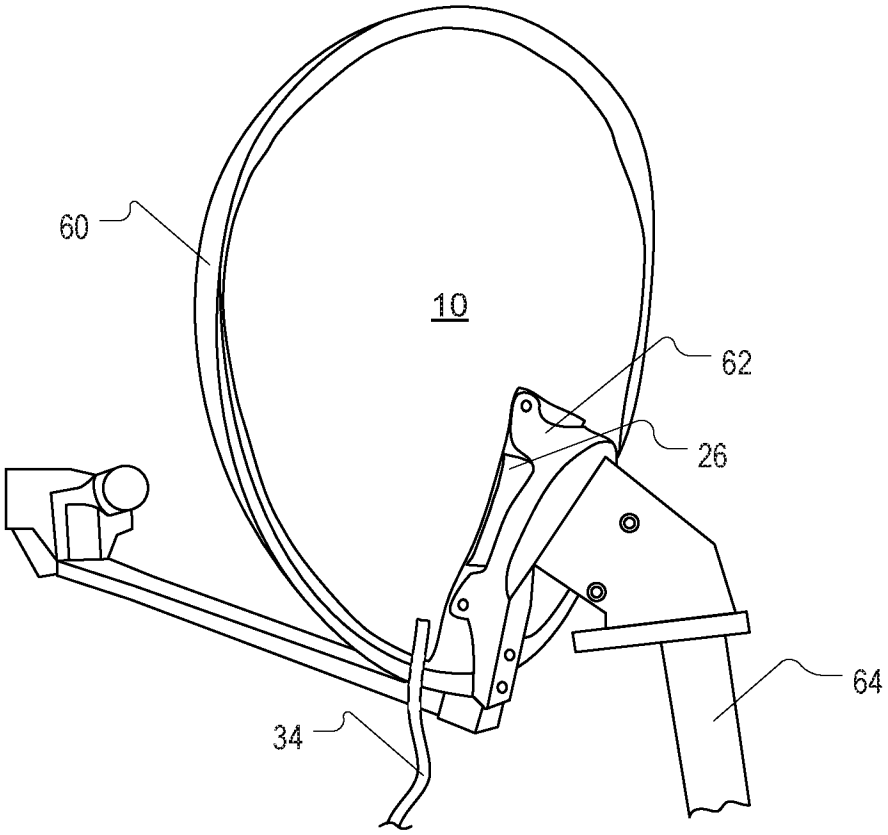
FIG. 5 illustrates a perspective view of embodiments of a satellite dish heater secured to a rear portion of a satellite dish.

Referring now to FIGS. 4 and 5, views of embodiments of a satellite dish heater secured to a satellite dish are shown. FIGS. 4 and 5 show that, at least in some embodiments, the satellite dish heater 10 is configured to be selectively and detachably attached to a rear surface of the dish 60 of a satellite dish. In some cases the user can gain access to the satellite dish to install the satellite dish heater 10 on the rear surface of the dish 60. The user can align the shape of the satellite dish heater 10 with the shape of the rear surface of the dish 60 (e.g., align the oval shape of the satellite dish heater 10 with an oval shape of the rear surface of the dish 60 or align the round shape of the satellite dish heater 10 with a round shape of the rear surface of the dish 60). The user can also align the cut-out portion 24 with one or more of a mounting bracket 62, a mounting pole 64, or other support components such as electrical connections, motors, power supplies, electronics, and any other similar satellite dish components. The user can also align the front flap 56 to contact the rear surface of the parabolic dish 60 over an area within the cut-out portion 24. In some cases, the user can align the front flap 56 to contact the rear surface of the parabolic dish 60 between mounting points of a mounting bracket. The front flap 56 can contact the rear surface of the parabolic dish 60 over an area within the cut-out portion 24 to allow generated heat to warm an area of the rear surface of the parabolic dish 60 to prevent a cold spot and prevent ice and/or snow accumulation in the area.

In some embodiments, the satellite dish heater 10 is secured to the rear surface of the parabolic dish 60 with the securing system 40. After aligning the satellite dish heater 10, the user can then selectively and detachably secure the satellite dish heater 10 to the rear surface of the parabolic dish 60 with the securing system 40. In some cases, the user can selectively and detachably secure the satellite dish heater 10 to the rear surface of the parabolic dish 60 with one or more magnets 42. In other cases, the user can selectively and detachably secure the satellite dish heater 10 to the rear surface of the parabolic dish 60 with one or more magnets 42, check alignment of the satellite dish heater 10 with the rear surface of the parabolic dish 60, and if the user is not satisfied with the alignment, remove the satellite dish heater 10, realign, and re-secure.

In some embodiments, after the satellite dish heater 10 is secured to the rear surface of the parabolic dish 60 with the securing system 40, the user connects the power supply line 34 to a power supply to activate the heating system 30. Once activated, the heating system 30 heats the satellite dish heater 10 and heat is transferred to the rear surface of the parabolic dish 60. The transferred heat then prevents, reduces, and/or removes snow and/or ice accumulation on the satellite dish. In some cases, the user can activate the heating system 30 as needed during and/or after a winter storm and/or freezing weather. In other cases, the user can leave the heating system 30 activated during a cold weather season. In yet other cases, the satellite dish heater 10 can be configured to be self-regulating and to activate itself as needed.

In some embodiments, the user can remove the satellite dish heater 10 by selectively and detachably removing the securing system 40 from the satellite dish. For example, the user can remove the satellite dish heater 10 at the end of the cold weather season for storage. In other cases, the user may elect to leave the satellite dish heater 10 in place year round. In some embodiments, the satellite dish heater 10 is configured so that the rear pad 20 contacts the rear surface of the parabolic dish 60. In other embodiments, the satellite dish heater 10 is configured so that the front pad 50 contacts the rear surface of the parabolic dish 60. In yet other embodiments, the satellite dish heater 10 is configured so that both the rear pad 20 and the front pad 50 are configured to contact the rear surface of the parabolic dish 60 depending on a configuration of the satellite dish and/or a preference of the user.

The satellite dish heater can have several useful features. First, a user can easily secure the satellite dish heater to a satellite dish without the need for any tools and/or the need to modify the satellite dish heater or the satellite dish. The user can simply align the satellite dish heater with the rear surface of the satellite dish and place the rear pad against the rear surface of the satellite dish to allow the magnets to secure the satellite dish heater. The user can then re-check the alignment. If the user is unsatisfied with the alignment, he or she can then easily remove the satellite dish heater, realign the satellite dish heater, and re-secure the satellite dish heater. At the end of a cold weather season, the user can easily remove the satellite dish heater for storage. Alternatively, the satellite dish heater can be left in place year round with a minimum of deterioration from exposure to the environment.

In some embodiments, the user secures the satellite dish heater without using additional screws, bolts, clips or other similar types of fasteners that can mar and/or damage the satellite dish. Additionally, because the front and rear pads can be flexible, the satellite dish heater can conform to various designs and configurations of satellite dishes. For example, an individual satellite dish heater can be secured to various satellite dishes that may differ in a curvature of the dish portion and/or may differ in an overall size of the dish portion.

Second, the satellite dish heater can comprise a cut-out portion and a flap to accommodate satellite dish components such as the mounting bracket and/or the mounting pole. The cut-out portion allows the user to secure the satellite dish heater while accommodating satellite dish components such as the mounting bracket and/or the mounting pole. The cut-out portion also allows the satellite dish heater to more fully contact the rear surface of the satellite dish while accommodating these mounting components and minimizing any portion of the satellite dish that is not heated. Furthermore, the flap can be configured to contact the rear surface of the satellite dish within the cut-out portion to further minimize any portion of the satellite dish that is not heated and to reduce snow and/or ice accumulation in this area.

Third, as described above, the satellite dish heater can be configured to be flexible to conform to the curvature of the rear surface of the satellite dish. By conforming to the curvature of the rear surface of the satellite dish, the satellite dish heater can maximize transfer of heat from the heating system to the satellite dish to reduce, remove, and/or prevent snow and/or ice accumulation on the satellite dish. Additionally, by maximizing this transfer of heat, the satellite dish heater can work more efficiently and consume less energy. The heating system can also be configured to be self-regulating to minimize overheating and energy waste. Also, by conforming to the curvature of the rear surface of the satellite dish, the satellite dish heater can comprise a low-profile design that can include one or more of being non-obstructive, having reduced visual impact, and having a low-profile configuration that is resistant to being damaged and/or removed by high winds.

Fourth, as described above, the satellite dish heater can be easily secured before cold weather to prevent injuries and/or death related to clearing snow manually and/or injuries and/or death related to the user having to access a snowy and/or icy rooftop. Securing the satellite dish heater before cold weather also prevents damage and/or misalignment caused by manually clearing the satellite dish. Also, the satellite dish heater can be activated before and/or during a cold weather event to prevent snow and/or ice from accumulating.

The terms "a," "an," "the" and similar referents used in the context of describing the disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the disclosure and does not pose a limitation on the scope of the disclosure otherwise claimed. No language in the specification should be construed as indicating any non-claimed element essential to the practice of the disclosure.

It is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

Groupings of alternative elements or embodiments of the disclosure disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this disclosure are described herein, including the best mode known to the inventors for carrying out the disclosure. Of course, variations on these described embodiments will become apparent to those of ordinary skill in the art upon reading the foregoing description. The inventor expects skilled artisans to employ such variations as appropriate, and the inventors intend for the disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

In closing, it is to be understood that the embodiments of the disclosure disclosed herein are illustrative of the principles of the present disclosure. Other modifications that may be employed are within the scope of the disclosure. Thus, by way of example, but not of limitation, alternative configurations of the present disclosure may be utilized in accordance with the teachings herein. Accordingly, the present disclosure is not limited to that precisely as shown and described.

I claim:

1. A heated satellite dish comprising:

a satellite dish;

a heating system in contact with the satellite dish comprising a rear pad configured to conform to a rear surface of a satellite dish;

the heating system configured to transfer heat to the satellite dish;

a securing system configured to selectively and detachably secure the satellite dish heater to a rear surface of the satellite dish; and wherein the rear pad further comprises a flap configured to contact the rear surface of the satellite dish within the cut-out portion.

2. The satellite dish heater of claim 1, wherein the rear pad further comprises a cut-out portion configured to accommodate a mounting bracket.

3. The satellite dish heater of claim 1, wherein the rear pad further comprises a synthetic rubber.

4. The satellite dish heater of claim 1, wherein the rear pad is configured to be flexible to conform to a rear surface of the satellite dish.

5. The satellite dish heater of claim 1, wherein the heating system comprises heating wire.

6. The satellite dish heater of claim 4, wherein the heating wire is configured to be self-regulating to provide a constant power output.

7. The satellite dish heater of claim 5, wherein the self-regulating heating wire is configured to provide a constant power output of about 3 to about 20 watts per foot at 50° F.

8. The satellite dish heater of claim 1, wherein the securing system comprises one or more magnets configured selectively and detachably secure the satellite dish heater to the rear surface of the satellite dish.

9. The satellite dish heater of claim 7, wherein the magnets comprise neodymium magnets.

10. A system for reducing snow and ice accumulation on a satellite dish comprising:

a flexible rear pad configured to conform to a rear surface of a satellite dish;

a heating wire attached to the flexible rear pad wherein the flexible front and rear pads further comprise a flap configured to contact the rear surface of the satellite dish within the cut-out portion;

a magnet attached to the flexible rear pad;

wherein the magnet is configured to selectively and detachably secure the satellite dish heater against the rear surface of the satellite dish, and wherein the heating wire is configured to transfer heat to the rear surface of the satellite dish to reduce snow and ice accumulation.

11. The system of claim 10, further comprising a flexible front pad attached to one or more of the flexible rear pad, the heating wire, and the magnet.

12. The satellite dish heater of claim 10, wherein the magnet is disposed between the flexible front pad and the flexible rear pad.

* * * * *